US006139475A

United States Patent [19]

Bessler et al.

[11] Patent Number: 6,139,475

[45] **Date of Patent: *Oct. 31, 2000**

[54] AMBULATORY AID DEVICE

[76] Inventors: Edward W. Bessler, 8 Rosemount Ave., Ft. Mitchell, Ky. 41017; Robert J. Roseberry, 5716 Hazel Dr., Florence, Ky. 41042

[ * ] Notice: This patent issued on a continued prosecution application filed under 37 CFR 1.53(d), and is subject to the twenty year patent term provisions of 35 U.S.C. 154(a)(2).

[21] Appl. No.: 09/065,897

[22] Filed: Apr. 23, 1998

[51] Int. Cl.[7] ..... A63B 22/00

[52] U.S. Cl. ..... 482/69; 482/66

[58] Field of Search ..... 482/66–69, 23, 482/43, 95, 143; 602/32–36; 606/241; 601/23; 5/81.1 R, 83.1, 86.1, 88.1, 89.1; 135/65–67

[56] References Cited

U.S. PATENT DOCUMENTS

| | | | |
|---|---|---|---|
| 1,611,807 | 12/1926 | Bergh | 482/69 |
| 2,516,553 | 7/1950 | Cole | 482/69 |
| 2,812,010 | 11/1957 | Abdallah | 482/69 |
| 3,778,052 | 12/1973 | Andow et al. | 482/69 |
| 5,165,123 | 11/1992 | Colpron | 5/83.1 |
| 5,333,333 | 8/1994 | Mah | 5/86.1 |
| 5,603,677 | 2/1997 | Sollo | 482/69 |
| 5,695,432 | 12/1997 | Soderlund | 482/69 |
| 5,788,606 | 8/1998 | Rich | 482/43 |

*Primary Examiner*—Richard J. Apley
*Assistant Examiner*—Lori Baker
*Attorney, Agent, or Firm*—R. Christian Macke

[57] ABSTRACT

An ambulatory aid device allowing self ambulation for impaired persons having reduced weight bearing capabilities. A wheeled framework provides overhead support by cables that are pulleyed and terminate on a locking winch. A harness comprising a torso harness and leg bindings for both legs is provided to which the cables are readily hooked and unhooked. An impaired person is lifted from a seated or reclining position by suiting him in the harness, attaching the cables and cranking the winch until he is in a substantially upright position with his feet on the ground, his body weight being at least partially supported by the harness and cable arrangement.

7 Claims, 11 Drawing Sheets

AMBULATORY AID DEVICE

TECHNICAL FIELD

This invention relates generally to an ambulatory aid device for use by a physically impaired user. A wheel mounted frame partially supports the weight of the impaired user such that the impaired user's legs and arms may be used to provide motive force for the device.

BACKGROUND OF THE INVENTION

There exists a wide variety of devices in the prior art comprising ambulatory aids for physically impaired users. These devices are of value to users in many different situations. For example, persons who have been injured or who have undergone surgery frequently use ambulatory aids as part of rehabilitation therapy with a goal of fully restoring their ability to ambulate without any aid. Other severely handicapped persons may use ambulatory aids to assist in ambulation even though there may be no future prospect for independent ambulation. With such handicapped users the devices are useful in that they allow some independent mobility and, by facilitating self ambulation by such persons, they prevent muscle atrophy that would otherwise result with continual non-use. Ambulatory aids thus prevent further deterioration of motor skills and muscle tissue in handicapped persons with limited ability by allowing such persons to use whatever limited abilities they may have to ambulate.

In many of the prior art devices the body weight of the impaired user is partially supported so that it does not have to be fully supported by the user's legs and feet. Well known devices such as walkers and canes provide partial support of an impaired person's body weight while still allowing use of the user's arm and leg motor skills to ambulate. Those devices provide support by allowing the user to partially support his body weight using his hands and arms.

Other devices in the prior art provide means for supporting the user's body weight by suspending him from overhead. Similar to walkers and canes, the full body weight of the user is not supported on the user's legs and feet. One particular overhead supporting device is disclosed in U.S. Pat. No. 5,569,129 to Seif-Naraghi et al. In the Seif-Naraghi '129 device, cables hanging down from overhead are attached to a body harness fitted to conform to a user's body, the cables being attached to an overhead, Y-shaped member. A user fitted with the harness is suspended from the overhead Y-shaped member such that his feet contact the floor surface. The only physical connection between the user and the device in the Seif-Naraghi '129 patent is the harness and cable connection to the Y-shaped member. The user's arms and hands provide no function with the Seif-Naraghi '129 device, nor is it contemplated that the user's arms and hands engage any part of the Y-shaped member or supporting structure. The harness of the Seif-Naraghi '129 device is fitted to the torso of the user and includes a crotch piece extending between the user's legs upon which much of the user's weight is supported.

The Seif-Naraghi '129 device is a rehabilitation aid providing means for allowing an impaired user to go from partially supporting his weight on his legs and feet to fully supporting his weight on his legs and feet. The Seif-Naraghi '129 device does not, however, allow the user to use his hands and arms to propel the device, the presence of an assistant being necessary to propel and steer the device, as shown in FIGS. 8–10 of the Seif-Naraghi '129 patent.

A problem with the prior art devices such as canes and walkers is that a severely impaired user must often be lifted or assisted to a standing position to use these devices. In addition, walkers and canes can only be used when the impaired user is capable of supporting most of his own weight on his legs and feet and has adequate balance and motor function that allows him to maintain a standing position after being lifted or assisted. Further, the impaired user's motor skills and balance must be adequate to overcome the instability of the device. Such devices cannot be used with a severely impaired user who has very limited function of the motor skills in his legs or who is incapable of supporting most of his own body weight on his legs and feet.

The prior art overhead suspension devices, such as that in the Seif-Naraghi '129 patent discussed herein, while reflecting improvement over canes and walkers, remain disadvantageous because the rehabilitation provided thereby requires the impaired user to go abruptly from having his body weight partially supported by overhead cables to having his full weight supported by his legs and feet. It does not provide, by itself, gradual multiple phase rehabilitation of, first, being supported by overhead cables to, second, being supported by the cables as well as his hands and arms, in addition to his legs and feet, to, third, being supported solely on his legs and feet. Also, the prior art overhead suspension devices such as that disclosed in the Seif-Naraghi '129 patent, do not include any provisions for engagement by the impaired user's hands or arms. As a result, the prior art devices do not allow the impaired user to partially support his weight on his hands and arms or to use his hands, arms and upper body to help push those prior art devices along. The known overhead suspension devices do not include a cage-like frame, hand rests, arm rests, grip handles or any other provision allowing the impaired user to steady or balance himself.

Some prior art overhead suspension devices such as the Seif-Naraghi '129 arrangement disclose a body harness attached to overhead cables. The harness is worn by the user and suspended from the overhead cables to support the weight of the user, the primary point of support being at a crotch member of the harness passing between the user's legs. Such an arrangement is clearly disadvantageous and uncomfortable for the user, and may even cause additional injuries such as chafing due to frictional rubbing between the user's legs. These body harnesses having through crotch pieces are disadvantageous for another reason. Besides being uncomfortable and presenting a risk of possible injury, these harnesses have the added disadvantage of having to be completely removed for a user to use the bathroom because of the obstruction presented by the through crotch piece.

The prior art overhead suspension devices such as the Seif-Naraghi '129 arrangement are thus disadvantageous because they do not include a cage-like frame allowing an impaired user greater balance and stability by being engageable by the user's arms and hands. The cage-like frame would also provide a means for allowing the user to self propel the device using his hands, arms and upper body. A cage-like frame would further allow the device to be steered by the impaired user by utilizing his hands and arms to turn the device in a particular direction.

There is, thus, a need for an ambulatory aid device wherein a wheel mounted frame provides means for supporting an impaired user's body weight engageable by his hands and arms, so that his body weight does not have to be fully supported from overhead cables. Such a device has the added benefit of allowing gradual rehabilitation of an impaired user, wherein the impaired user's body weight is, first, predominately supported by overhead cables to, second, being supported by the overhead cables as well as the user's hands and feet to, third, being supported by the feet only. A wheel mounted frame with hand rests or hand rails or hand grips is advantageous because it allows an impaired user to use his hands and arms to balance and steady himself, while also allowing him to use his hands and arms to push the device along. It further gives the user the ability to steer the device using his hands and arms.

An overhead suspension ambulatory aid device is also needed utilizing a body harness wherein the necessity for a crotch piece is eliminated. The present invention overcomes the obstacles and disadvantages of the prior art and provides such an improved ambulatory aid device for impaired persons.

OBJECTS OF INVENTION

Accordingly it is an object of the present invention to provide an ambulatory aid device for impaired users overcoming the limitations and disadvantages of the prior art.

It is an object of the present invention to provide a wheeled ambulatory aid device having provisions for supporting part of the user's weight from overhead, while also providing members as part of a frame that can be engaged by the arms and hands of the user.

Another object of the present invention is to provide a wheeled ambulatory aid device for use in rehabilitation of impaired persons allowing gradual progression from initially supporting most of the user's weight from overhead cables to, eventually, supporting the weight from the overhead cables as well as from the user's hands and arms and legs and feet, wherein said device there is included means for the user to partially support himself using his hands and arms.

A further object of the present invention is to provide an ambulatory aid device including cables for supporting a user's body weight from overhead cables, the device also including provisions allowing the user to provide the motive force for the device without requiring the assistance of another person or any other motive force.

Yet another object of the present invention is to provide an ambulatory aid device including a harness worn by a user and attached by overhead cables to a wheeled frame allowing the user to provide the motive force for the device.

Another object of the present invention is to provide an ambulatory aid device wherein a harness, worn by a user and attached by overhead cables to a wheeled frame, at least partially supports the weight of the user at multiple points without requiring a crotch piece for support.

Yet another object of the present invention is to provide a harness for an impaired person to wear which can be attached to a lifting device to raise the impaired person from a seated or reclining position to a standing position wherein said harness does not interfere with the user using the bathroom.

These and other objects of the present invention are satisfied by the preferred embodiments of the invention described in more detail herein. These objects are meant to be illustrative and not limiting. The manner of operation, novel features and further objects and advantages of this invention may be better understood by reference to the description and drawings set forth herein.

SUMMARY OF THE INVENTION

According to the foregoing objectives, this invention is an ambulatory aid device comprising a wheeled frame from which an impaired user is supported, which frame includes members that can be engaged by the arms and hands of the impaired user. The user is supported from overhead cables that are attached to a crotchless body harness.

The present invention comprises an ambulatory aid device allowing physically impaired users greater mobility, the device comprising a cage-like frame mounted on wheels. The frame is a rigid structure having overhead members to which an impaired person is connected and from which the impaired person is suspended. The frame also includes means for engagement by the impaired person's hands and arms.

Hand grips providing the means for engagement by the user's hands and arms are comprised of members of the frame. The hand grips are positioned to allow the impaired person to propel the framework along without the aid of any other motive force or assistance from any other individuals.

The means for suspending the impaired user from the frame comprise cables affixed to the frame. The cables are affixed at a low point on the frame and wrap around pulleys such that they are suspended from overhead members of the frame. A harness worn by the impaired person has means for linking the harness with the cables. On the frame, at the lower point of affixation, is mounted a means for winding and unwinding the cables. The overhead cables are lengthened, by unwinding from a spool, to allow linkage to the harness worn by an impaired person seated or reclining outside the frame. Once the cables and harness are linked, the cables are rewound onto the spool to lift the impaired person from a seated or reclining position into an upright standing position within the frame.

The harness disclosed in the present invention comprises a torso wrap connected to two leg wraps. The harness further comprises means for attachment to the overhead cables, the attachment means comprising multiple rings sewn into the torso wrap.

The harness of the present invention comprising a torso wrap connected to two leg wraps does not require a crotch piece to support the weight of the user, and the harness is adjustable to accommodate different size users. Means for adjusting the harness include laces in the back and adjustable Velcro straps wrapped through rings in the front.

DETAILED DESCRIPTION OF THE INVENTION

Figure 1:
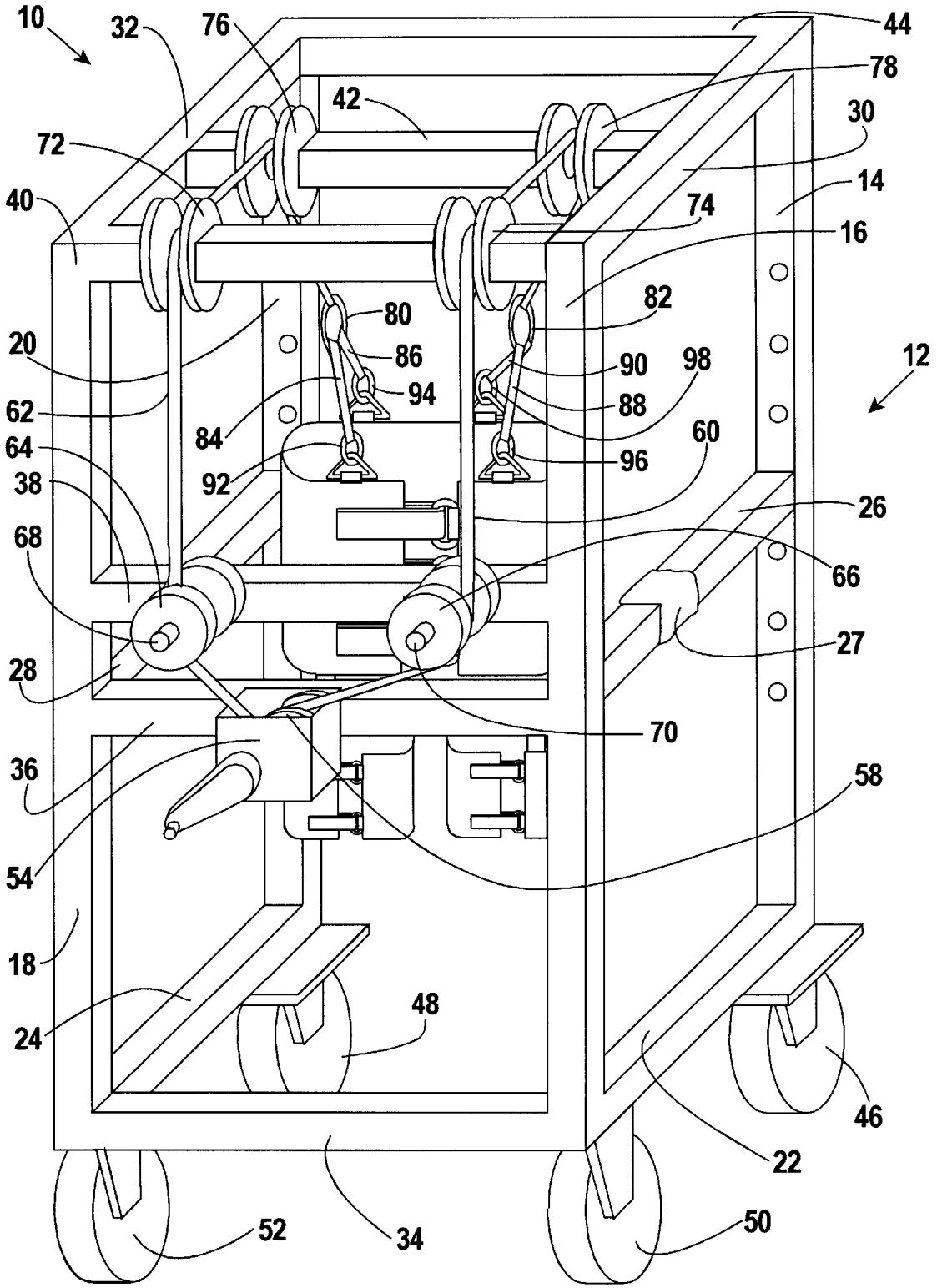
FIG. 1 is a perspective view of the ambulatory aid device of the present invention showing the wheeled framework and an empty harness suspended therefrom.

The ambulatory aid device 10 of the present invention is illustrated in FIG. 1. It includes a cage-like frame 12 having vertical members 14, 16, 18, 20 and horizontal side members 22, 24, 26, 28, 30, 32. The cage-like frame 12 also includes horizontal cross members 34, 36, 38, 40, 42, 44. A user of the ambulatory aid device 10 is substantially enclosed and surrounded on three sides and above as if in a cage by the vertical members 14, 16, 18, 20, horizontal side members 22, 24, 26, 28, 30, 32 and horizontal cross members 34, 36, 38, 40, 42, 44. While the frame 12 may be constructed of any material including wood and plastic or any other stable material, in the most preferred embodiment of the present invention it is constructed of welded steel members.

Figure 7:
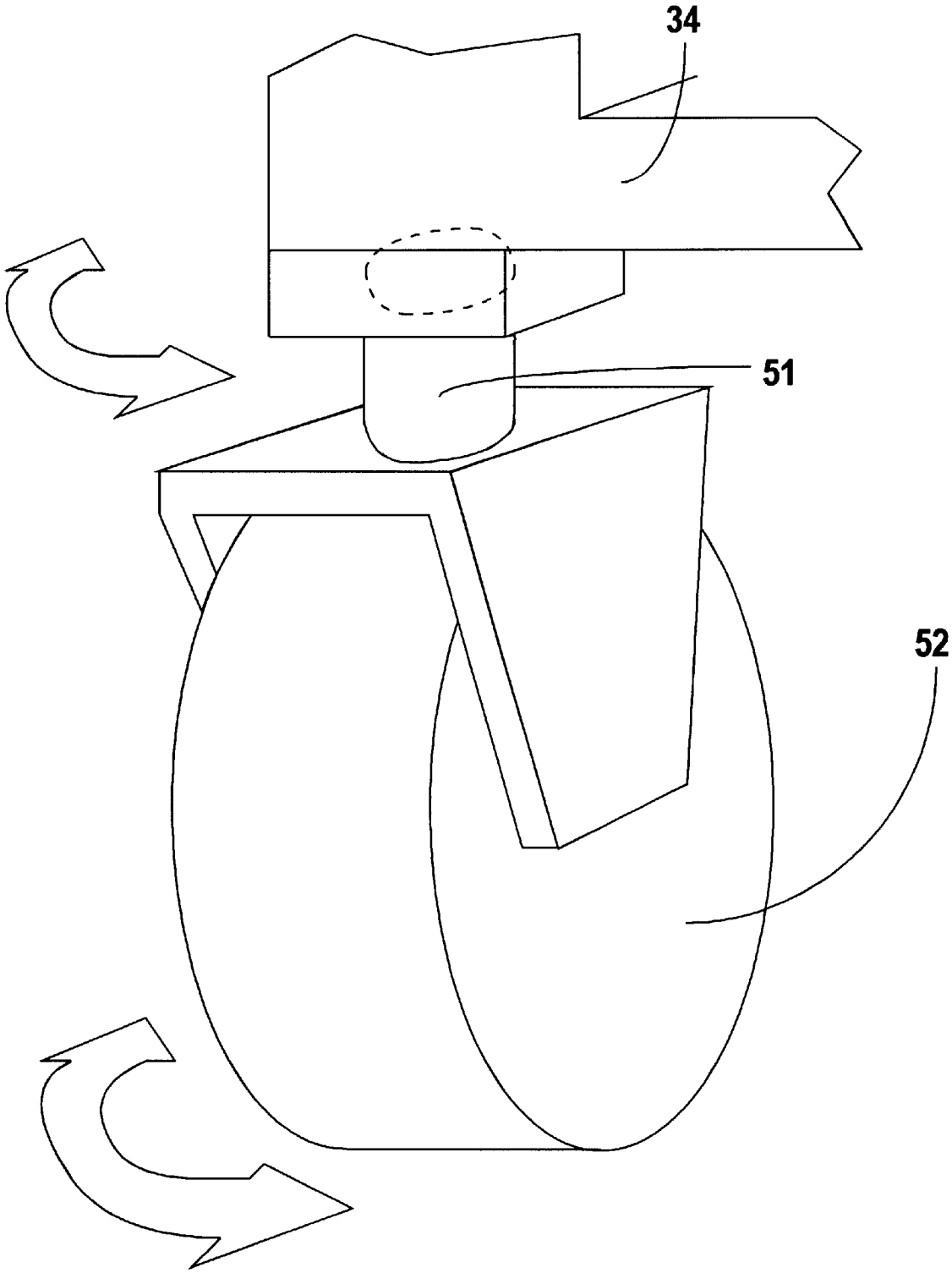
FIG. 7 is a detailed view showing the caster mounting of the front wheels.

The cage-like frame 12 is mobile by virtue of being mounted on multiple wheel assemblies 46, 48, 50, 52. In the preferred embodiment shown in FIG. 1, rear wheels 46, 48 and front wheels 50, 52 are mounted to the frame 12 on the underside of horizontal side members 22, 24. The rear wheels 46, 48 are rigidly affixed and are permanently locked in the orientation shown, parallel to the horizontal side members 22, 24 on which they are mounted. The front wheels 50, 52, meanwhile, are caster mounted, as shown in FIG. 7, allowing pivotal rotation about pin 51 in the directions illustrated by the arrows. The pivoting of the front wheels 50,52 provides the means for steering the device 10.

Figure 6:
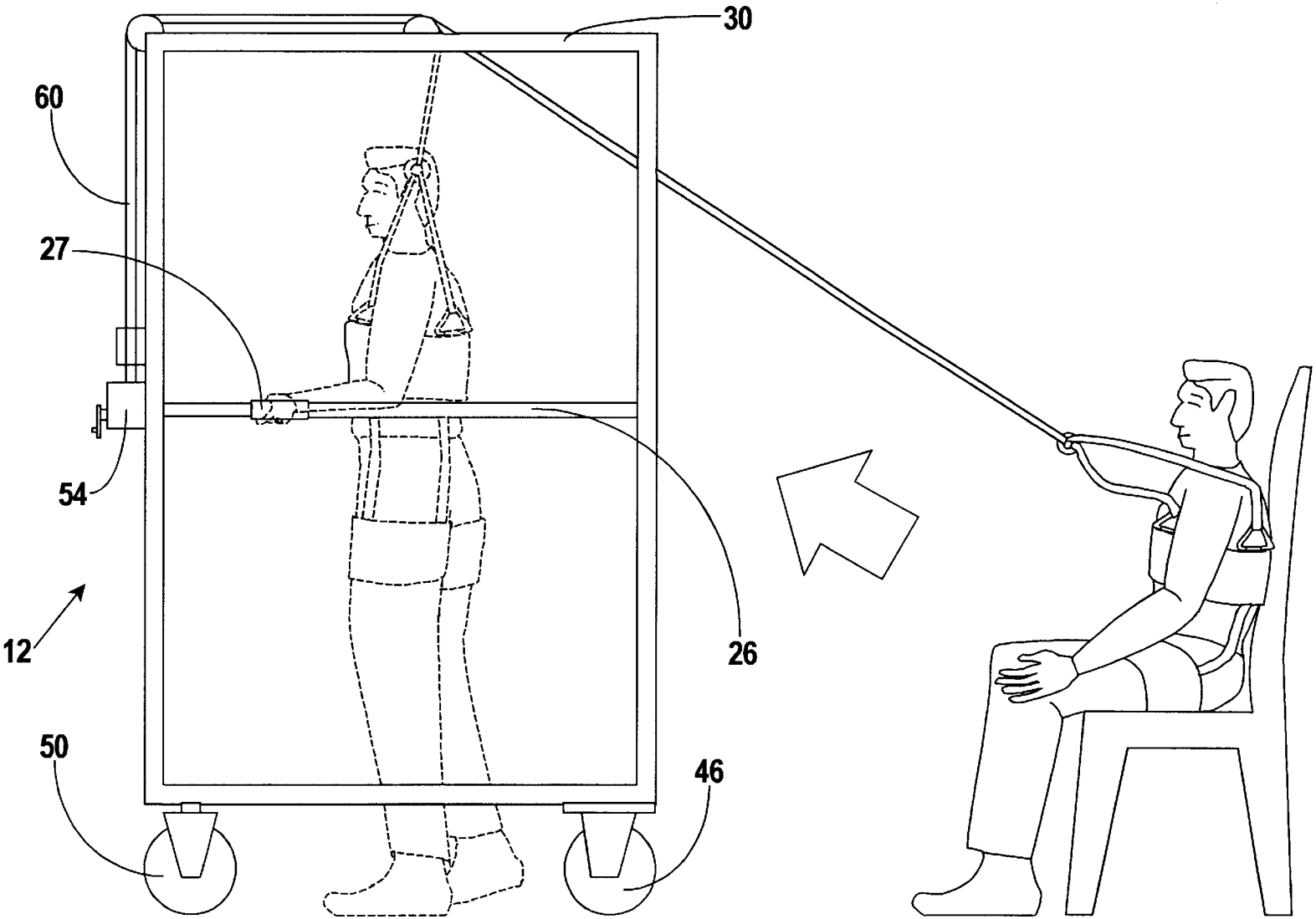
FIG. 6 is a pictorial representation of the harness with the frame depicting the lifting of the impaired person from a seated position to the position allowing ambulation with the frame.

Two horizontal side members 26, 28 comprising part of the frame 12 are positioned midway up between the lower horizontal side members 22, 24 and upper horizontal side members 30, 32. The horizontal side members 26, 28 make the frame 12 more stable overall by their inclusion. The horizontal side members 26, 28 also provide a convenient means for the user to engage the frame 12 with his hands and arms, as shown in FIG. 6. The user, by gripping the horizontal side members 26, 28 is able to at least partially support his body weight using his hands and arms.

Figure 10:
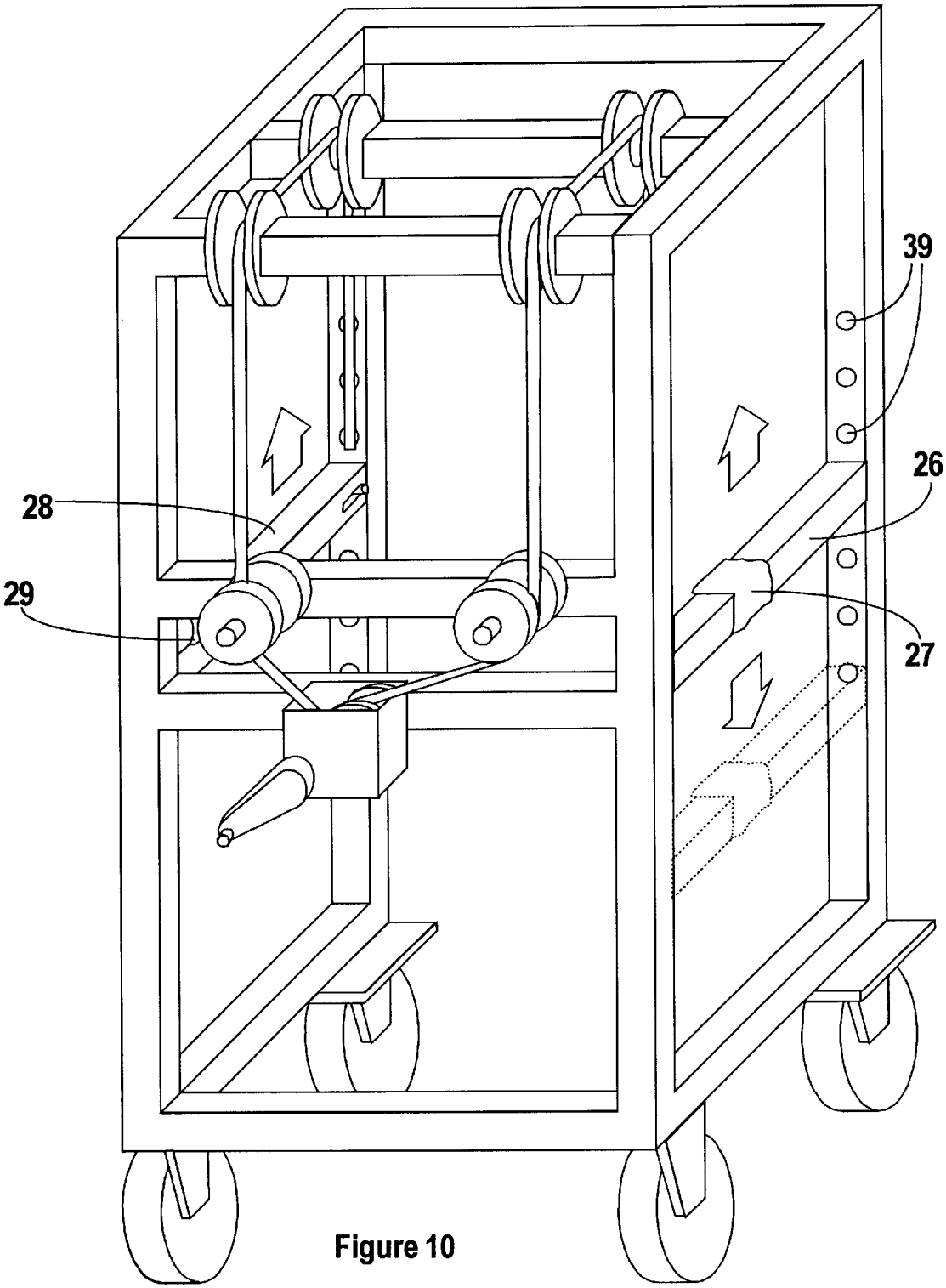
FIG. 10 is a perspective view of the ambulatory aid device reflecting the adjustability of the horizontal side members.
Figure 11:
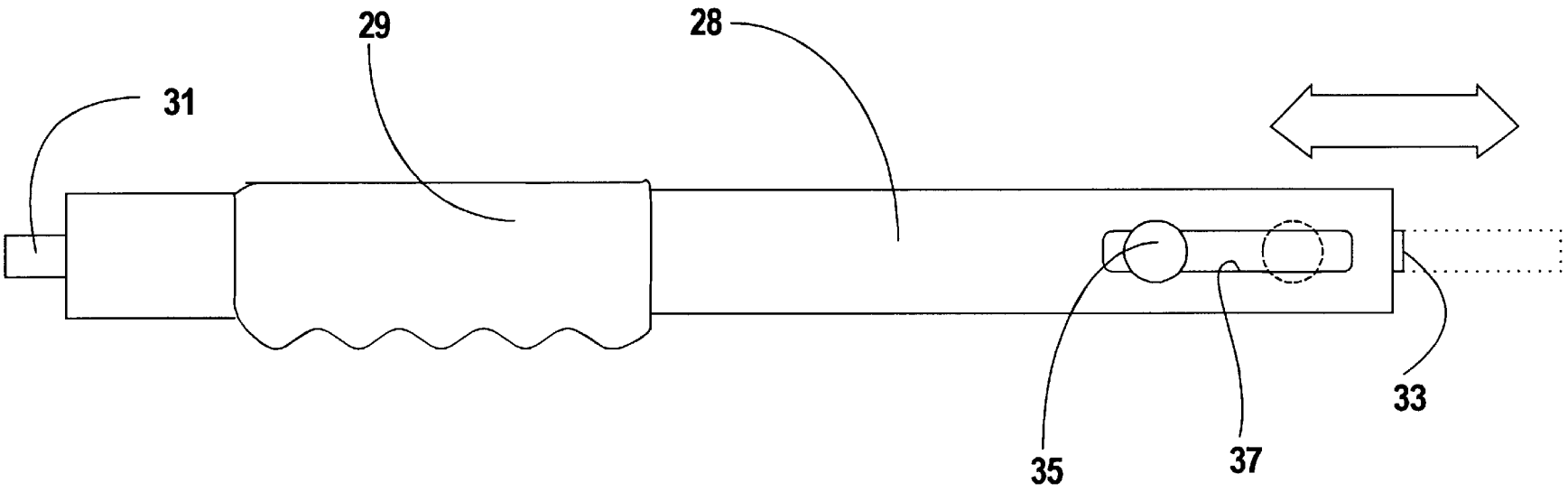
FIG. 11 is a detail view of a removable horizontal side member with a fixed connector pin and retractable connector pin.

As indicated by the arrows in FIG. 10, the horizontal side members 26, 28 are adjustable so that they can be positioned at various heights between the lower horizontal members 22, 24 and upper horizontal members 30, 32. The horizontal side member 28, shown in FIG. 11, has a means for connection including a connector pin 31 securely affixed to one end while a retractable connector pin 33 is attached at the other end. The retractable connector pin 33 has a lateral extension 35 which extends through and is slidable in a slot 37 formed in the horizontal side member 28. A user extends and retracts the retractable connector pin 33 by grabbing the lateral extension 35 and sliding it back and forth in slot 37.

The horizontal side member 28 is installed between vertical member 18 and vertical member 20 by first inserting fixed connector pin 31 in one of the holes 45 in front vertical member 18. Once the fixed connector pin 31 is inserted, the retractable connector pin 33 is retracted and the horizontal side member 28 is arranged such that it is level and parallel to the lower horizontal side member 24 and upper horizontal side member 32. Once it is level, the retractable connector pin 33 is extended to engage a hole 39 in rear vertical member 20 corresponding in height to the position of the hole 45 engaged by the fixed connector pin 31. The horizontal side member 28 can thereafter have its height adjusted by retracting the retractable connector pin 33 and changing its position such that the fixed connector pin 31 and retractable connector pin 33 engage different of said holes 45 and holes 39. The horizontal side member 26 has similar means for connecting it between and to front vertical member 16 and rear vertical member 14. Provision of the simple connection means thereby makes the horizontal side members 26, 28 height adjustable and allows the cage-like frame 12 to be modified to accomodate users of different physical sizes. The horizontal side members 26, 28 are readily adjusted to a position that is convenient and comfortable for the user to engage the hand grips 27, 29 mounted thereon. Hand grips 27, 29 are provided on the horizontal side members 26, 28 at a position near the front to provide a convenient, comfortable and slip resistant point at which the horizontal side members 26, 28 can be engaged by the user.

In addition, by engaging the frame 12 at horizontal side members 26, 28 and applying force in a forward direction, the user provides motive force for the device 10. As a result of this forward force the device 10 will roll forward on wheels 46, 48, 50, 52. If the user, using his hands and arms, applies unequal forward force to the horizontal side members 26, 28, the device 10 and frame 12 experiences greater movement in the direction in which the greater force is applied. As a result, the user can steer the device 10 and make it turn in a particular direction by applying differing forces to the horizontal members 26, 28.

Figure 8:
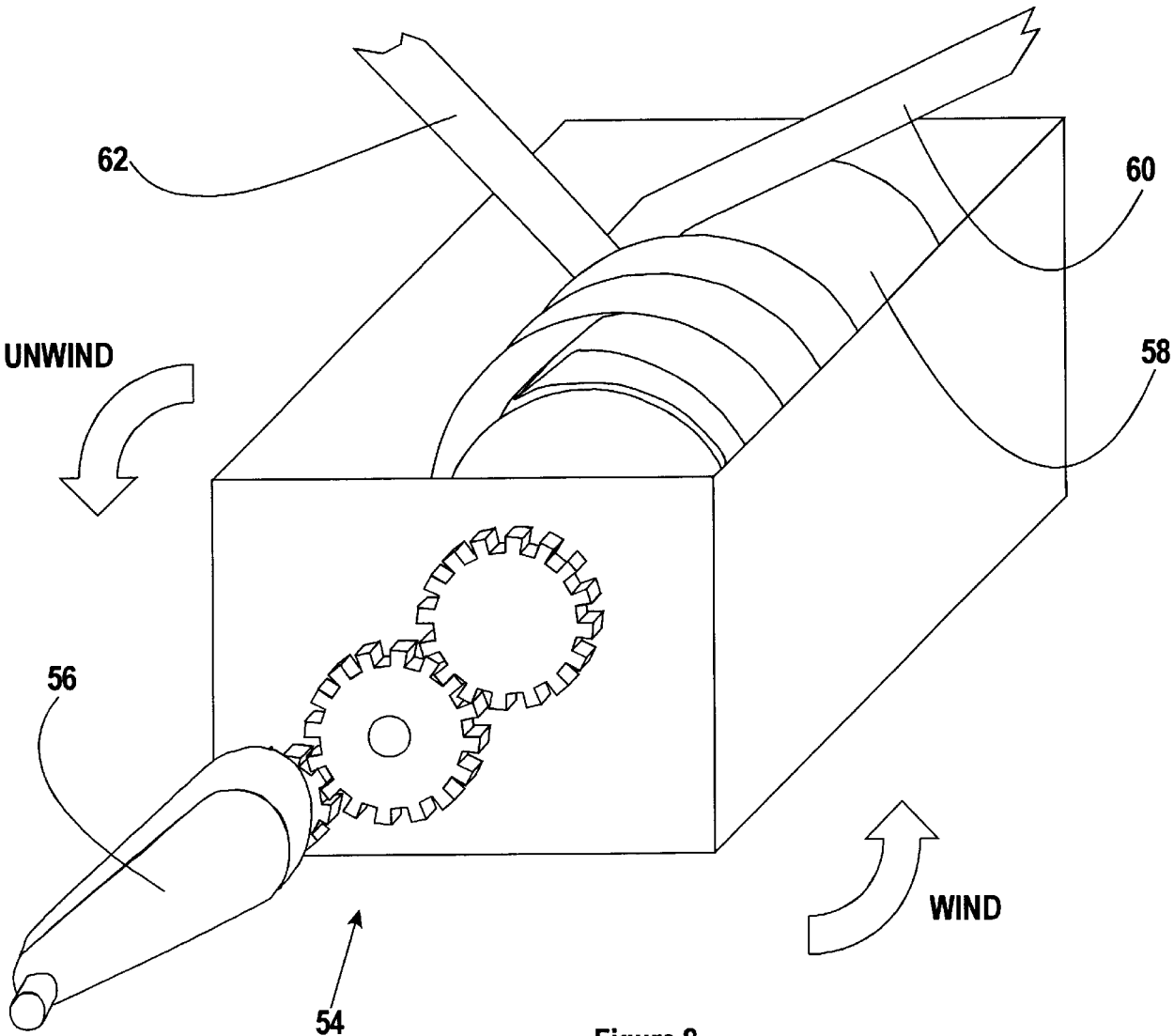
FIG. 8 is a detailed view showing the winch housing and cables wound on the winch.

On the front side of the horizontal cross member 36 is mounted a winch housing 54. A more detailed view of the winch housing 54 is shown in FIG. 8. An accessible handle 56 external to the winch housing 54 can be rotated to rotate a spool 58 which is located within the winch housing 54 and mechanically linked to the handle 56. A pair of cables 60, 62 are securely affixed at one end to the spool 58 and wound about the spool 58 in the same direction such that rotation in the counterclockwise direction winds the cables 60, 62 onto the spool 58, while clockwise rotation unwinds the cables 60, 62 (FIG. 8). Once the spool 58 has been adequately wound to suspend the user in the desired position, a locking mechanism (not shown) is applied to hold the spool 58 and cables 60, 62 in the position. To release the user, the locking mechanism is disengaged and the spool 58 rotated to unwind the cables 60, 62.

Figure 9:
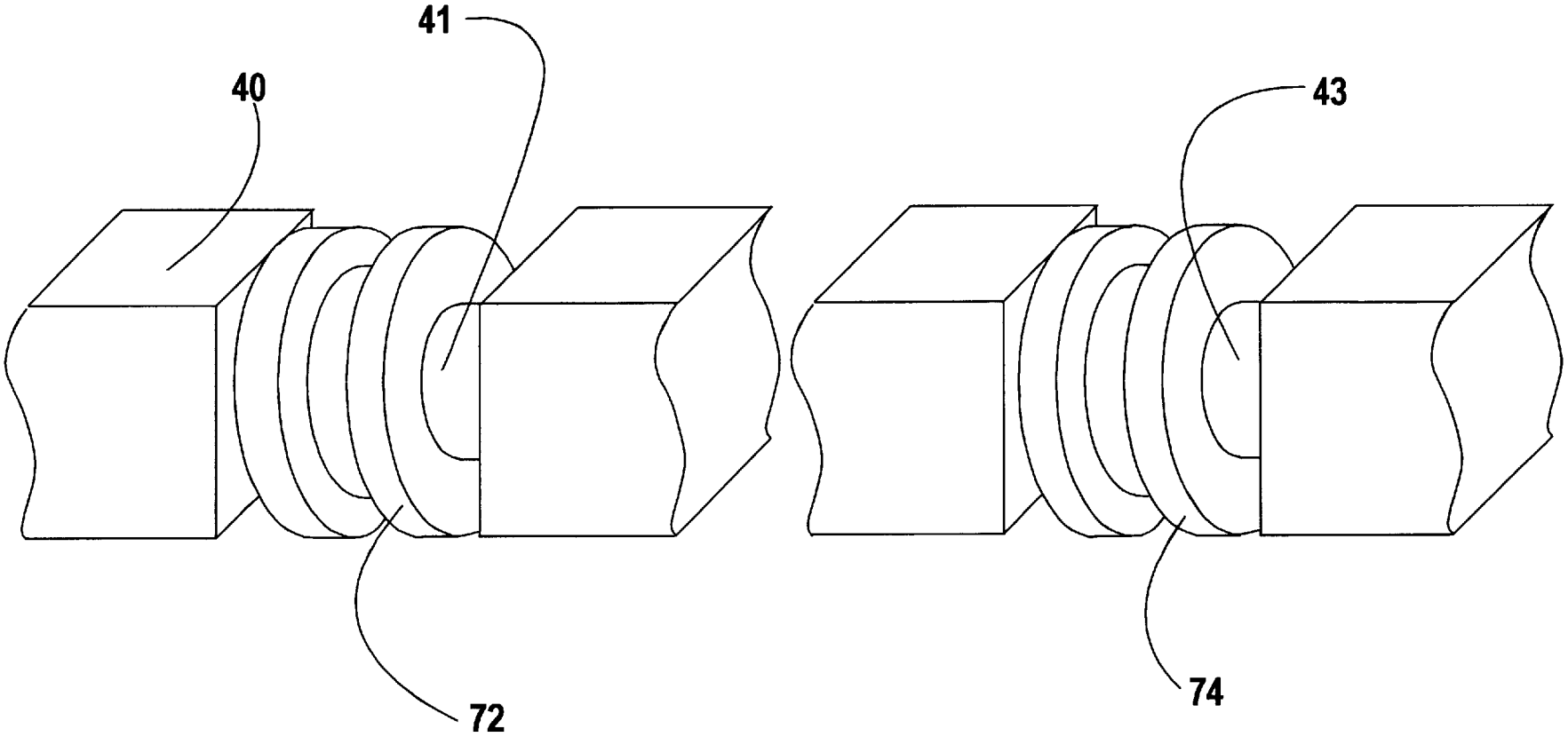
FIG. 9 is a detailed view showing the top pulley members mounted on overhead members of the frame.

As shown in FIG. 1, the cables 60, 62 extend from the spool 58 and winch housing 54 around a pair of front pulley wheels 64, 66 which are rotatably mounted on axles 68, 70. The cables 60, 62 then extend upwardly and engage forward top pulley wheels 72, 74, and rear top pulley wheels 76, 78. The forward top pulley wheels 72, 74 are mounted on and are free to rotate on cylindrical portions 41, 43 of horizontal cross member 40 (see FIG. 9), while the rear top pulley wheels 76, 78 are mounted on and are free to rotate on a cylindrical portions 45, 49 (not shown, similar to cylindrical portions 41, 43 of horizontal cross-member 40 shown in FIG. 9) of horizontal cross member 42.

The cables 60, 62 hang down vertically from the rear top pulley wheels 76, 78, terminating at link rings 80, 82. Two short cable extensions 84, 86 extend from link ring 80 and cable 62, while two similar cable extensions 88, 90 extend from link ring 82 and cable 60. The cable extensions 84, 86, 88, 90 terminate in manually operable hooks 92, 94, 96, 98 which can be opened to receive a solid link piece or loop and closed to maintain the engagement with the solid link piece or loop.

A harness 100 used in conjunction with the ambulatory aid device 10 of the present invention is shown hanging from the device 10 in FIG. 1. The harness 100 is also shown by itself in FIG. 2. The harness 100 comprises several individual sections that are interconnected so that it may be adjusted for various size users and to allow quick and easy application to the user.

Figure 2:
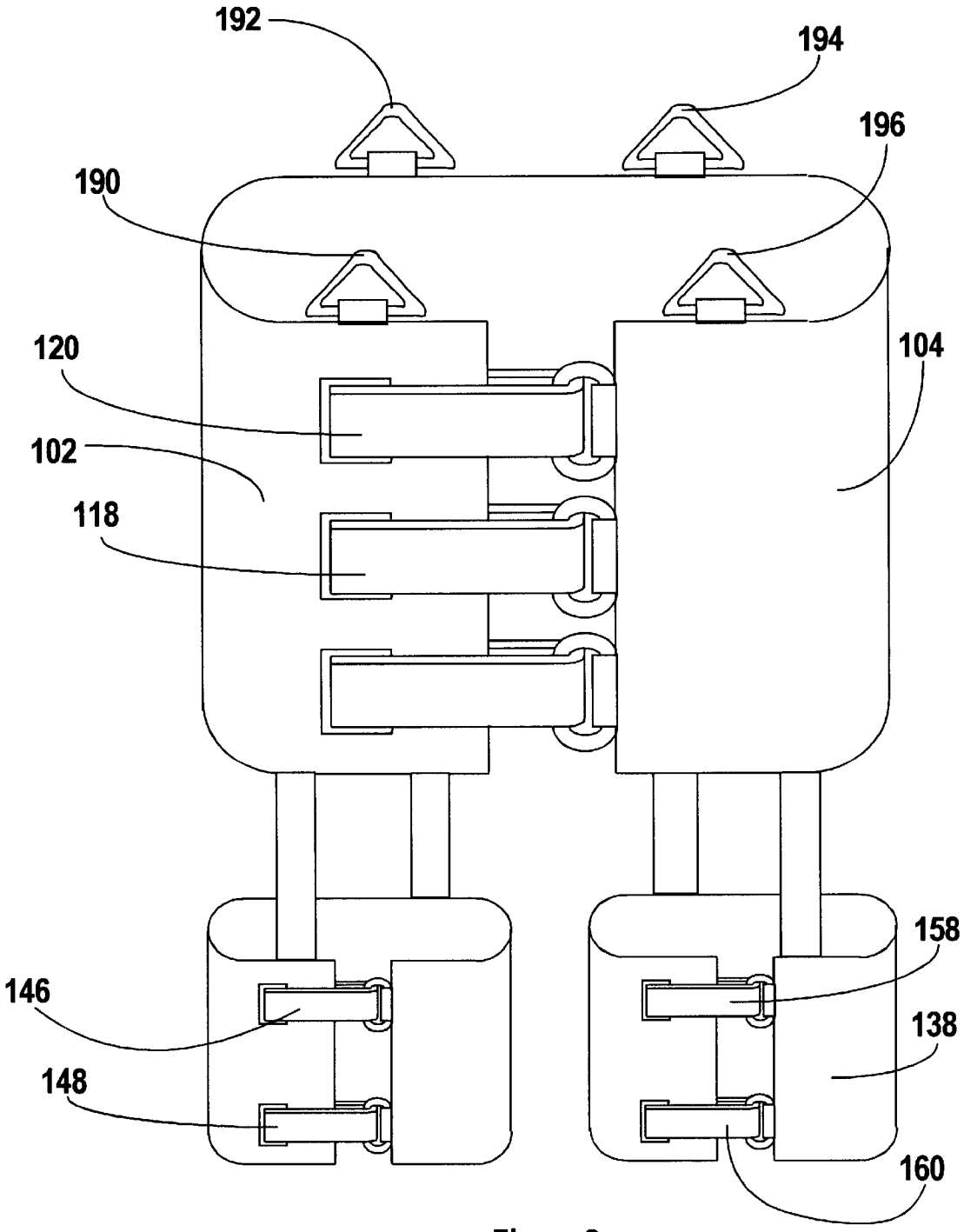
FIG. 2 is a perspective front representation of the empty harness fitted as it is when worn by a user.
Figure 3:
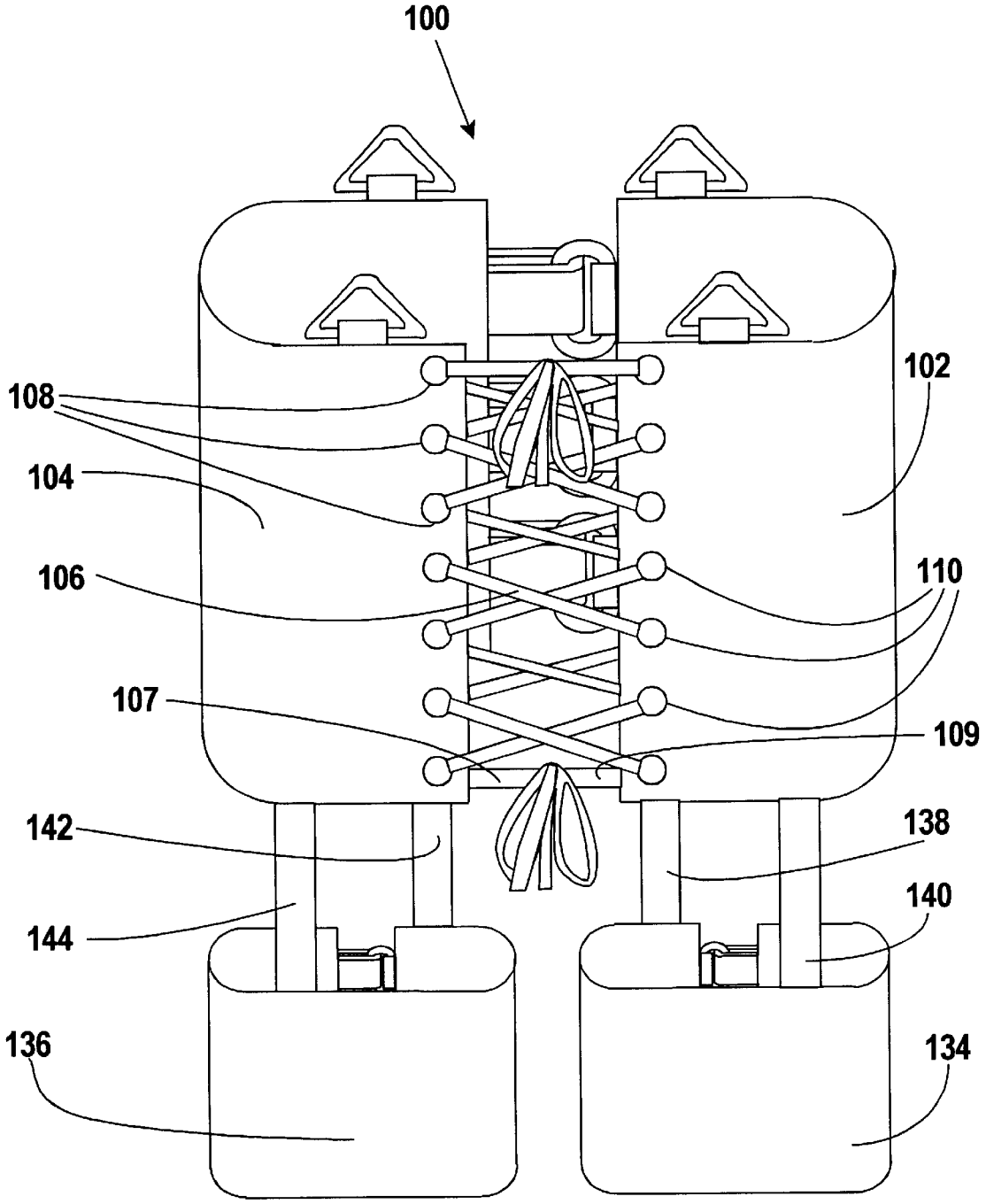
FIG. 3 is a perspective rear representation of an empty harness fitted as it is when worn by a user.
Figure 4:
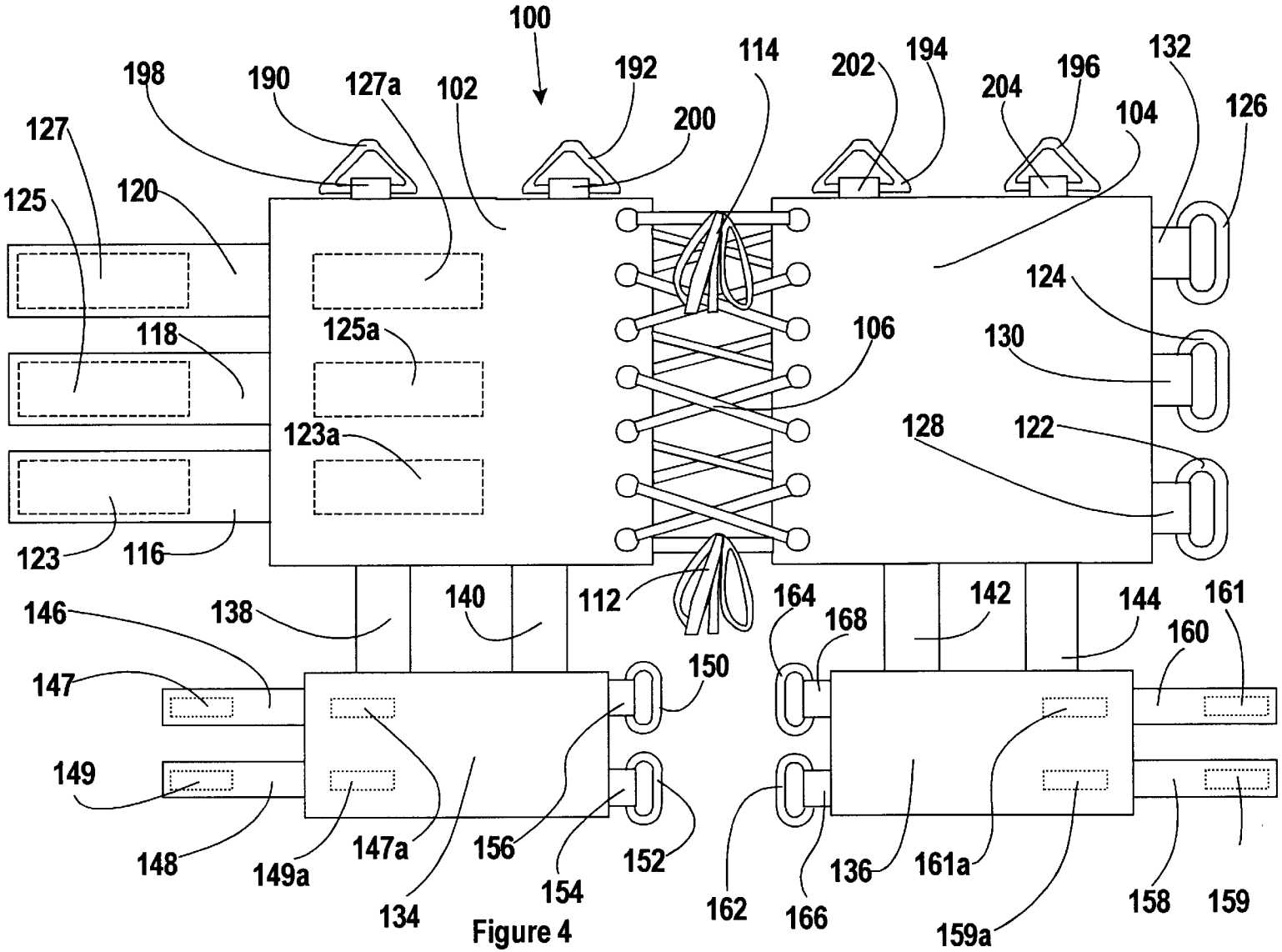
FIG. 4 is a two dimensional representation of the harness as it appears when not worn and laid flat.

The harness 100, shown as it is worn in FIGS. 1 and 2, is shown in its laid flat and unworn condition in FIG. 4. Two torso sections 102, 104 are interconnected by lace webbing 106. A pair of laces 107, 109 extend through multiple eyelets 108, 110 in the torso sections 102, 104. The laces 107, 109 are tied together at their bottom ends 112 and at their top ends 114. The laces 107, 109 are tied and the lace webbing 106 loosened or tightened as necessary to fit a specific user. The lace webbing 106 thereby provides a means for adjusting the size of the torso sections 102, 104 to fit a user depending upon the user's girth.

Figure 5:
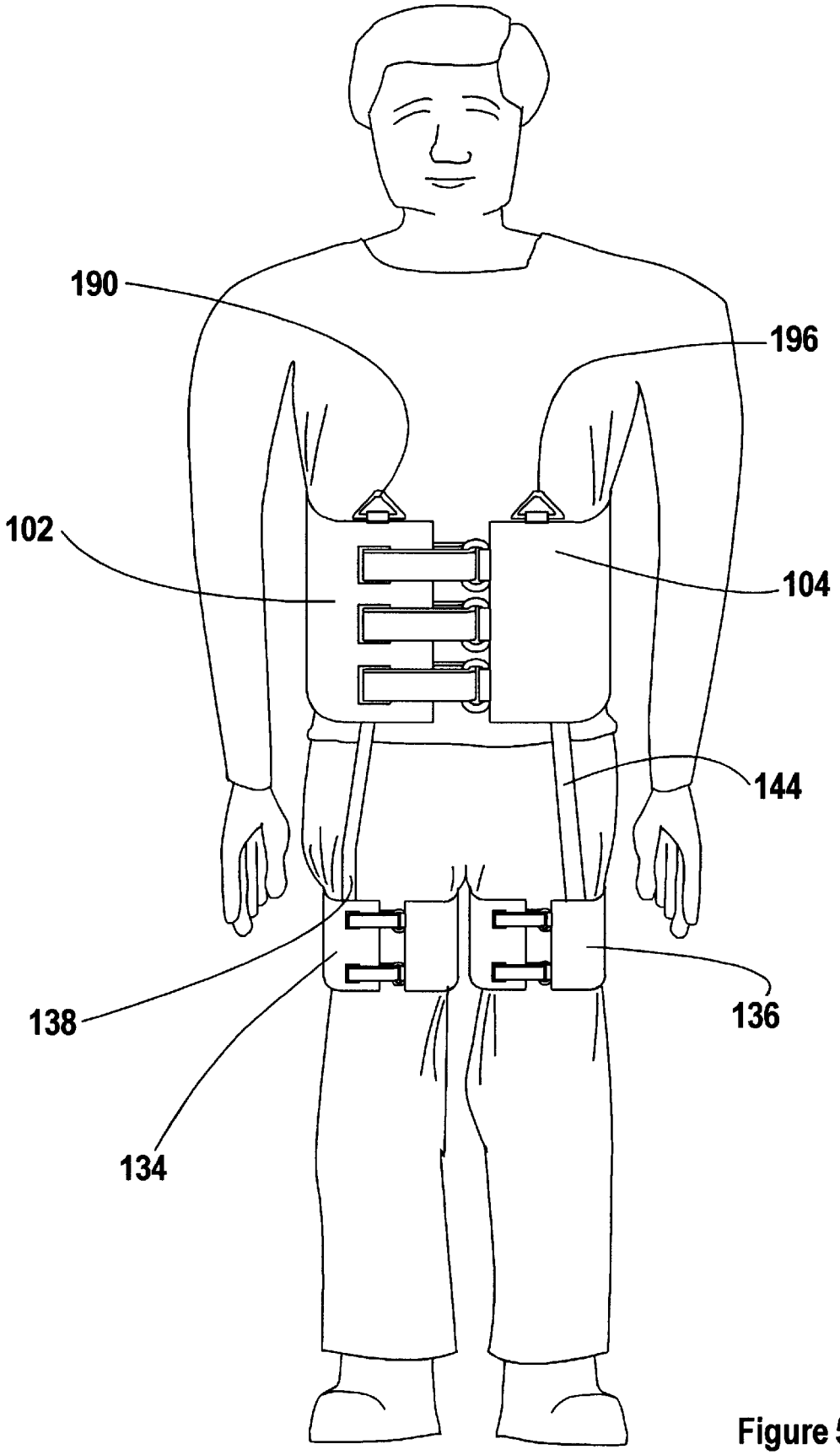
FIG. 5 is a pictorial representation of a user fitted with the harness.

This lace webbing 106 connection between two torso sections 102, 104 is adjacent to the back of the user when it is worn as shown in FIG. 5. In the front, an interconnection means between the torso sections 102, 104 is provided by straps 116, 118, 120 and three rings 122, 124, 126. The straps 116, 118, 120 are securely affixed to torso section 102. In the preferred embodiment the straps 116, 118, 120 are affixed to the torso section 102 by stitching, although other equivalent means of affixing may be used without departing from the principles of the present invention. In the preferred embodiment the rings 122, 124, 126 are affixed to torso section 104 by material loops 128, 130, 132 which are sewn into and securely affixed to torso section 104.

Other means of affixing the rings 122, 124, 126 to the torso section 104 are specifically contemplated such that this use does not depart from the principles of the present invention. The straps 116, 118, 120 have strips 123, 125, 127 of hook fasteners securely affixed to the external side, while corresponding strips 123*a*, 125*a*, 127*a* of loop fasteners are securely affixed to the torso section 102. The front interconnection between the torso sections 102, 104 is formed and maintained by extending the straps 116, 118, 120 through the rings 122, 124, 126, then folding the straps 116, 118, 120 back over onto themselves until the hook strips 123, 125, 127 affixed to the straps 116, 118, 120 engage the loop strips 123*a*, 125*a*, 127*a* affixed to the torso section 102. In this way the hook and loop fasteners 123, 125, 127, 123*a*, 125*a*, 127*a* cooperate to hold the straps 116, 118, 120 in place and, when adequately tightened, secure the torso sections 102, 104 snugly about the user's torso as shown in FIG. 5 such that no slippage or riding up on the user occurs.

A right leg piece 134 is connected to torso piece 102 by fixed vertical straps 138, 140 while a left leg piece 136 is connected to torso piece 104 by vertical straps 142, 144. Similar to the torso section connections, the leg pieces 134, 136 have means for interconnecting themselves comprising straps 146, 148, 158, 160 and rings 150, 152, 162, 164. The means for interconnecting the right leg piece 134 to engage the user's leg is provided by straps 146, 148 which are securely affixed to right leg piece 134. The straps 146, 148 extend through rings 150, 152 which are securely affixed to leg material loops 154, 156, the loops 154, 156 being sewn directly to right leg piece 134. The left leg piece 136 has a similar interconnection provision provided by straps 158, 160 and rings 162, 164 which are rigidly affixed to material loops 166, 168 sewn to left leg piece 136.

Similar to the front interconnection between the torso sections 102, 104, the leg straps 146, 148, 158, 160 have affixed to them hook fastener strips 147, 149, 159, 161 which cooperate with loop fastener strips 147*a*, 149*a*, 159*a*, 161*a* which are affixed to right leg piece 134 and left leg piece 136. The straps 146, 148, 158, 160 are extended through the rings 150, 152, 162, 164 and are folded over onto themselves so that their hook and loop fasteners 147, 149, 159, 161, 147*a*, 149*a*, 159*a*, 161*a* hold them in place on an upper portion of the user's thigh, as shown in FIG. 5. When adequately tightened, the right leg piece 134 engages the user's right leg and the left leg piece 136 engages the left leg without any allowance of slippage or riding up.

The design of the harness 100 includes torso engaging sections 102, 104 and leg sections 134, 136, but it specifically does not include a piece extending through the crotch of the user. This is intentional and beneficial in that the user's weight need not be supported on a crotch piece. The interconnection between the torso sections 102, 104 with right leg piece 134 and left leg piece 136 thereby provide a harness 100 that distributes the weight bearing between the torso and legs, eliminating the need for a crotch support. The crotchless harness 100 is also beneficial in that it provides the user the opportunity to use the ambulatory aid device 10 to go to and from bathroom facilities and to use the bathroom facilities without requiring removal of the harness 100.

At the top of the torso sections 102, 104 are affixed support rings 190, 192, 194, 196. These support rings 190, 192, 194, 196, as shown in FIG. 4, are triangular in shape and affixed to the torso sections 102, 104 by loops 198, 200, 202, 204 which are securely sewn to the top of the torso sections 102, 104.

A user is outfitted with the harness 100 as shown in FIG. 5, and appropriate adjustments are made so that the torso sections 102, 104 and leg pieces 134, 136 are adequately tightened and adjusted so that they engage the user securely and in prevention of any sliding movement. The cage-like frame 12 is positioned near the user who has been outfitted with the harness as shown in FIG. 6. The cables 60, 62 are then sufficiently unwound from winch 54 such that they can engage the support rings 190, 192, 194, 196 while the user is in a seated or reclining position, as shown in FIG. 6. The cables 60, 62 are then rewound onto the winch 54 lifting the user out of the chair or reclining position and into the cage-like frame 12 as shown in FIG. 6. The horizontal side members 26, 28 provide hand rails upon which a user can partially support his weight, in addition to having it partially supported by the cables 60, 62. The hand rails 26, 28 also provide the user the ability to self propel the cage-like frame 12 by pushing it forward. By virtue of the pivoting caster mounted front wheels 50, 52, the user can even steer the device 10.

This invention provides a stable cage-like frame 12 mounted on wheels 46, 48 50, 52. The inclusion of horizontal side members 26, 28 provide the means for a user to engage the frame 12 with his hands and arms. This is beneficial because the user can propel the frame 12 forward, rolling on its wheels 46, 48, 50, 52 without any assistance from other persons or motive forces. The device 10 thereby allows even severely impaired users to be independently mobile once the user is strapped into the harness 100 and hooked to the cables 60, 62. The device 10 also allows use of motor skills and muscles by a user to ambulate when the user would otherwise be unable to ambulate.

The present device is also beneficial because it allows gradual rehabilitation of an injured user. The device 10 can be used as the user's rehabilitation progresses from, first, supporting the user predominately from the overhead cables 60, 62, to second, supporting the user from the cables 60, 62 as well as from his hands and arms by utilizing horizontal side members 26, 28, until finally no overhead support or support from the user's hands and arms are required, when the rehabilitation is complete and the user can support himself solely on legs and feet.

What is claimed is:

1. An ambulatory aid device comprising:

a frame surrounding a user on three sides and above comprising a rigid structure of multiple vertical members and multiple horizontal members, said frame mounted on multiple wheel assemblies;

means for engagement by a user's hands and arms comprising hand grips;

means for overhead support of a user; and means for suspending a user form said overhead support means;

wherein said suspending means comprises forward overhead pulley wheels mounted on a cylindrical portion of a first horizontal cross member; rear overhead pulley wheels mounted on a cylindrical portion of a second horizontal cross member; and a pair of cables extending from a spool and engaging said forward top pulley wheels and rear overhead pulley wheels;

wherein said frame substantially encloses a user and wherein said engaging means further comprises two horizontal side members comprising said frame, said horizontal side members having a means for connecting to said frame;

wherein said engaging means further comprises hand grips mounted on said horizontal side members, said hand grips being positioned such that said frame is propelled by a user through the application of force to said hand grips;

wherein said two horizontal side members are positioned midway up said frame and make said frame more stable;

wherein said tow horizontal side members comprise height adjustable members of said frame, said two horizontal side members having retractable connector means, each of said two horizontal side members being securely affixed to one of said vertical members at one end and attached to a second of said vertical members with a retractable connector pin at the other end.

2. The ambulatory aid device of claim 1 further comprising means for winding and unwinding said pair of cables.

3. The ambulatory aid device of claim 2 further comprising a body harness worn by the user, said body harness supporting the weight of the user without requiring a crotch piece.

4. The ambulatory aid device of claim 2 wherein said means for winding and unwinding comprises a winch affixed at a low point on said frame.

5. The ambulatory aid device of claim 3 wherein said suspending means comprises a pair of cables engaging multiple pulleys affixed to said frame.

6. The ambulatory aid device of claim 5 further comprising means for winding and unwinding said pair of cables to lift a user out of a chair or reclining position and into said frame.

7. The ambulatory aid device of claim 6 wherein said harness further comprises an adjustable torso wrap member connected to two leg wrap members.

* * * * *